United States Patent [19]

Burr et al.

[11] 4,339,736

[45] Jul. 13, 1982

[54] CONVERGENCE UNIT FOR CATHODE-RAY TUBE

[75] Inventors: Peter Burr, Winchester; Brian D. Chase, Eastleigh, both of England

[73] Assignee: International Business Machines Corporation, Armonk, N.Y.

[21] Appl. No.: 271,739

[22] Filed: Jun. 8, 1981

[30] Foreign Application Priority Data

Jun. 13, 1980 [EP] European Pat. Off. ..... 80301992.6

[51] Int. Cl.[3] ..... H01H 1/00

[52] U.S. Cl. ..... 335/213; 335/210

[58] Field of Search ..... 335/210, 212, 213

[56] References Cited

U.S. PATENT DOCUMENTS

| | | | |
|---|---|---|---|
| 4,122,421 | 10/1978 | Malerba | 335/213 |
| 4,128,824 | 12/1978 | Mirsch | 335/213 |
| 4,228,413 | 10/1980 | Campbell | 335/213 |

*Primary Examiner*—George Harris

*Attorney, Agent, or Firm*—Frederick D. Poag

[57] ABSTRACT

Convergence of the beams of an in-line gun shadow mask cathode-ray tube is provided by windings on a common core and generating pairs of quadruple and six-pole magnetic fields, respectively. The core is provided with non-magnetic ribs each having a projection for the purpose of locating the windings.

3 Claims, 5 Drawing Figures

CONVERGENCE UNIT FOR CATHODE-RAY TUBE

TECHNICAL FIELD

This invention relates to a convergence unit for an in-line gun shadow mask cathode-ray tube.

BACKGROUND ART

It is well known that a quadrupole magnetic field influences the beams generated by the three in-line guns by moving the outer beams in opposite directions and that a six-pole magnetic field moves the outer beams in the same direction.

British Patent Specification No. 1466732 (U.S. Pat. No. 3,902,145) describes the use of quadrupole and six-pole fields in converging in-line beams. The quadrupole unit consists of two concentric magnetic rings each with four poles distributed about its periphery. The two rings are relatively rotatable and can also be rotated together as a unit. The strength of the quadrupole field is adjusted by adjusting the relative angular position of the two rings. The direction of the quadrupole field is determined by the angular position of the unit. A similar arrangement is provided for adjusting the six-pole field.

British Patent Specification No. 1532462 (U.S. Patent No. 4,045,754) describes how, for more accurate convergence, the six-pole two concentric magnetic ring arrangement should be replaced by two such arrangements each mounted asymmetrically of the in-line beams. The specification also describes how each six-pole structure can be replaced by a twelve-pole electromagnet connected as two six-pole electromagnets angularly separated by 30°. The disadvantage of this proposal is that very careful adjustment is required not to lead to shift of the center beam. This excludes use as a dynamic convergence unit.

U.S. Pat. No. 4,027,219 shows a static convergence unit formed from a magnetic strip upon which coils have been wound. No means are shown to maintain the position of the coils during or after manufacture.

SUMMARY OF THE INVENTION

It is required to provide a convergence system that is more flexible, more easily adjustable, and more precisely manufacturable than is described in these patent specifications.

It is especially desirable to provide a system which can be driven by integrated electronic circuitry thus increasing the reliability and the sensitivity of adjustment available, and that the magnetic qualities and coil arrangement be such as to provide predictable performance when operated dynamically by such circuitry.

According to the invention, a convergence unit for use with an in-line gun shadow mask cathode-ray tube, comprises means for generating six-pole and four-pole magnetic fields centered on the central axis of the tube neck, wherein the means for generating the six-pole magnetic fields includes a pair of six-pole windings on a common core and arranged when energized to generate respective six-pole magnetic fields differing in angular position by 30°, wherein the means for generating the four-pole magnetic fields includes a pair of four-pole windings on a common core and arranged when energized to generate respective four-pole magnetic fields differing in angular position by 45°, and wherein the six-pole and four-pole windings are on the same common toroidal core, characterized in that the toroidal core is preformed and that the windings are formed in place thereon.

The use of single, preformed core for both windings provides several advantages:

- the arrangement is compact and need occupy less than 1 cm along the cathode-ray tube neck;
- the overlap and field sharing between windings is such that there is low mutual inductance;
- electrically, the arrangement is of high efficiency enabling cheap and reliable integrated circuitry to be used for driving the windings;
- the magnetic qualities of the core are undisturbed during manufacture; and,
- although adjacent cores provide low reluctance return paths for the fields generated by the respective windings on the cores, a much better return path is provided by the single core.

The provision of coil-locating ribs on the core facilitates winding in place on the preformed core and maintenance of accurate positioning of the coils during and after winding.

The unit according to the invention is preferably a dynamic convergence unit but its use as a static convergence unit is possible.

The foregoing and other objects, features, and advantages of the invention will be apparent from the following more particular description of a preferred embodiment of the invention as illustrated in the accompanying drawings.

DETAILED DESCRIPTION

Figure 1:
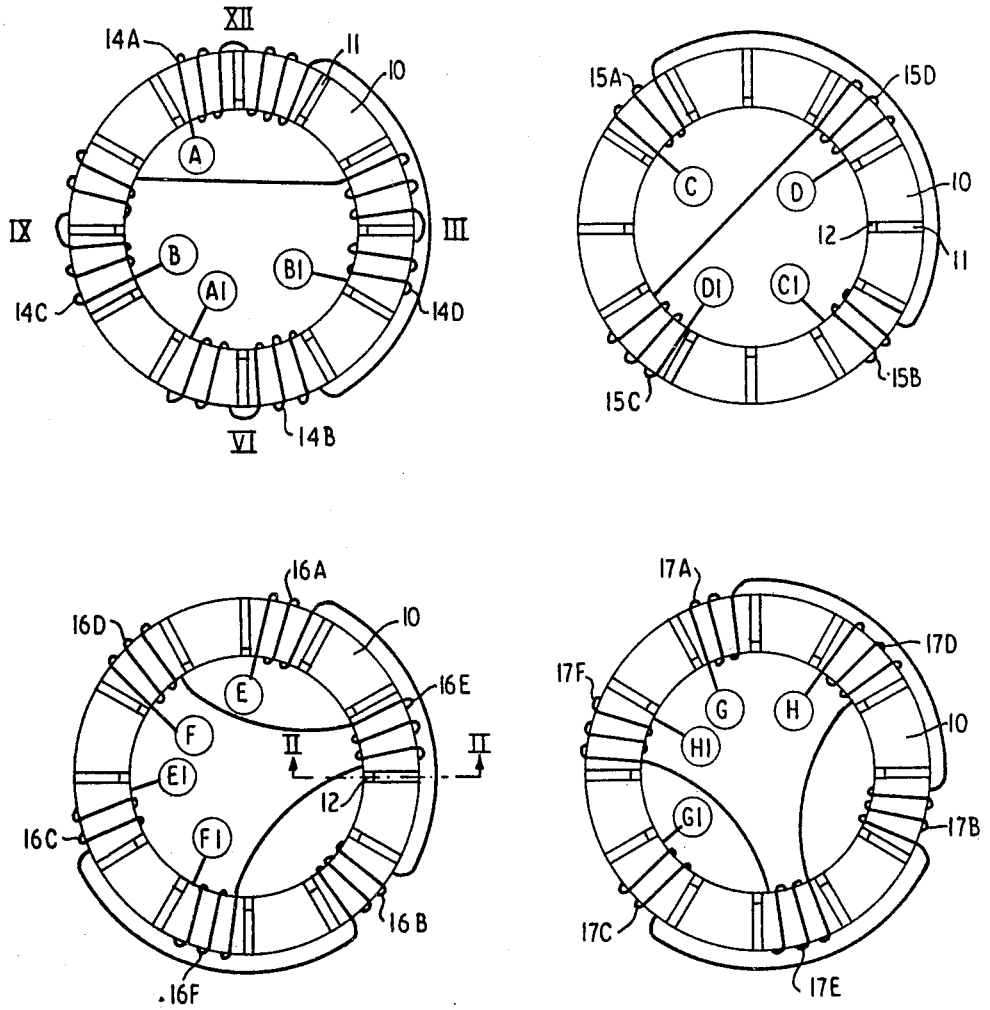
FIG. 1 shows diagrammatically the preferred arrangement of the windings of the convergence unit according to the invention.
Figure 2:
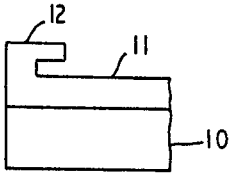
FIG. 2 is a cross section on the line II—II of FIG. 1.
Figure 3:
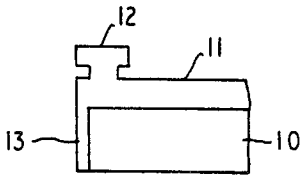
FIGS. 3 and 4 show different designs of the ribs 11.
Figure 4:
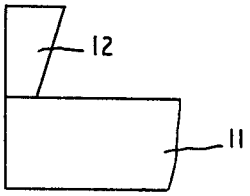

Referring to FIG. 1, in accordance with the preferred embodiment of the invention, a mu-metal or ferrite toroid 10 has one annular face divided into twelve equal segments by non-magnetic ribs 11 (see also FIG. 2). Each rib is provided with a projection 12 which extends so as to form a peg or hook about which the wire of the winding can be secured, as will be explained below. FIG. 3 shows an alternative design. The projections 12 are studs and the ribs 11 extend outwardly from a circular band 13 of such size as to fit closely within the inner circumference of toroid 10. The design of FIG. 3 has the advantage that the ribs 11 do not need to be secured to the toroid 10, as is necessary with the design of FIG. 2. Another design of projection 12, which makes molding of the ribs easier, is shown in FIG. 4.

FIG. 1 shows schematically the locations and connections of the four windings. In practice, all turns are wound in the same direction and, since it is required to have current flowing in opposite directions in successive sets of turns in order to minimize the inductance, alternate sets of turns are wound in one operation and connections are made after the winding operation. For ease of reference, the twelve ribs 11 are referenced according to their positions on the toroid 10, in the manner of the hours of a clockface, using Roman numerals. In order to show the windings clearly, in FIG.

1 each winding is shown separately on toroid 10. The first four-pole winding has sets of turns 14A to 14D. Turns 14A are between ribs XI and I and are continued as turns 14B between ribs V and VII. The windings 14A, 14B terminate at A1. Turns 14C are between ribs VIII and X and are continued as turns 14D between ribs II and IV. The end B1 of turns 14D is connected to end A1 of turns 14B. Drive currents are supplied to ends A and B of turns 14A and 14C, respectively.

The second four-pole winding comprises turns 15A to 15D between ribs X and XI, IV and V, VII and VIII, and I and II, respectively. The windings 15A, 15B and 15C, 15D are, respectively, continuous. The ends C1 and D1 of turns 15B and 15C are connected and power is supplied to ends C and D of turns 15A and 15D.

The first six-pole winding comprises sets of turns 16A to 16F of which windings 16A to 16C and 16D to 16F are, respectively, continuous. The sets of turns 15A to 16F are respectively between ribs XII and I, IV and V, VIII and IX, X and XI, II and III and VI and VII. The end E1 of turns 16C is connected to the end F1 of turns 16F. Power is supplied to the ends E and F of turns 16A and 16D, respectively. The second six-pole winding occupies the segments of toroid 10 not occupied by the first six-pole winding and comprises the six sets of turns 17A to 17F, of which 17A to 17C and 17D to 17F are, respectively, continuous, and of which the end G1 of turns 17C is connected to the ends H1 of turns 17F. Power is supplied to the ends G and H of turns 17A and 17D.

Figure 5:
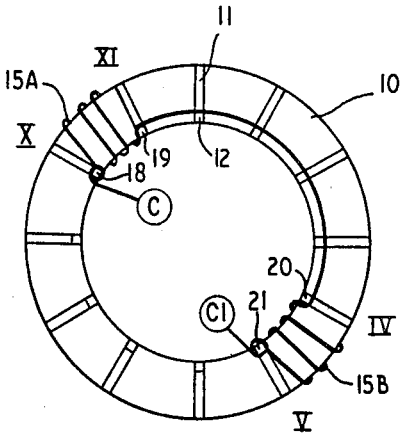
FIG. 5 illustrates the use of the projections on the ribs.

FIG. 5 shows the use of the projections 12. By way of example, sets of turns 15A and 15B are shown. The wire is taken about projection 18 of rib 10, the desired number of turns is made and the wire taken about projection 19 of rib XI. The wire is then taken to projection 20 of rib IV, engaging the projections 12 of the intervening ribs. The turns 15B are then made and the wire taken about projections 21 of rib V, leaving the end C1 free.

The system described in British Patent Specification No. 1517119 (U.S. Pat. No. 4,203,051) and British Patent Application No. 38584/77 (FR Specification No. 2,403,703; U.S. Pat. No. 4,203,054) provides a suitable means for supplying appropriate currents to the convergence unit. Digital representations of the current magnitudes are stored. As the electron beams scan the screen, the stored value appropriate to the current position of the beams is retrieved, converted to its analog current equivalent and supplied to the convergence unit. Since there are four windings on the convergence unit, there will, in fact, be four digital values corresponding to any given position of the beams.

While the invention has been particularly shown and described with reference to a preferred embodiment thereof, it will be understood by those skilled in the art that various changes in form and detail may be made therein without departing from the spirit and scope of the invention.

Having thus described our invention, what we claim as new and desire to secure by Letters Patent is:

1. A convergence unit for use with an in-line gun shadow mask cathode-ray tube, comprises means for generating six-pole and four-pole magnetic fields centered on the central axis of the tube neck, wherein the means for generating the six-pole magnetic fields includes a pair of six-pole windings on a common core and arranged when energized to generate respective six-pole magnetic fields differing in angular position by 30°, wherein the means for generating the four-pole magnetic fields includes a pair of four-pole windings on a common core and arranged when energized to generate respective four-pole magnetic fields differing in angular position by 45°, and wherein the six-pole and four-pole windings are on the same common toroidal core, characterized in that the toroidal core is preformed and that the windings are formed in place thereon, and in that at least one annular surface of the toroid is divided into segments by ribs, whereby the windings are located.

2. A convergence unit as claimed in claim 1, wherein the segments are equal and twelve in number, and wherein said ribs are non-magnetic.

3. A convergence unit as claimed in claim 1 or claim 2, wherein the end of each rib at or towards the inner circumference of the annulus is provided with a projection extending perpendicularly of the annulus.

* * * * *